US011118318B2

(12) United States Patent
Van Sant

(10) Patent No.: US 11,118,318 B2
(45) Date of Patent: Sep. 14, 2021

(54) WATER MAT SYSTEM

(71) Applicant: David M. Van Sant, Cumming, GA (US)

(72) Inventor: David M. Van Sant, Cumming, GA (US)

( * ) Notice: Subject to any disclaimer, the term of this patent is extended or adjusted under 35 U.S.C. 154(b) by 0 days.

(21) Appl. No.: 16/654,546

(22) Filed: Oct. 16, 2019

(65) Prior Publication Data

US 2021/0115632 A1 Apr. 22, 2021

(51) Int. Cl.

| | |
|---|---|
| ***E01D 15/20*** | (2006.01) |
| ***A47C 27/14*** | (2006.01) |
| ***A47C 27/15*** | (2006.01) |
| ***A47C 27/18*** | (2006.01) |
| ***A47G 9/06*** | (2006.01) |
| ***B63C 9/08*** | (2006.01) |

(52) U.S. Cl.

CPC ..... *E01D 15/20* (2013.01); *A47C 27/14* (2013.01); *A47C 27/15* (2013.01); *A47C 27/18* (2013.01); *A47G 9/06* (2013.01); *B63C 9/08* (2013.01)

(58) Field of Classification Search

CPC . A47G 9/00; A47G 9/06; A47G 27/00; A47G 27/02; A47C 27/08; A47C 27/14; A47C 27/15; A47C 27/18; A61G 7/00; A61G 7/10; A61G 7/102; B63C 9/00; B63C 9/08; E01D 15/00; E01D 15/20

USPC ..... 5/417, 419, 420; 441/129

See application file for complete search history.

(56) References Cited

U.S. PATENT DOCUMENTS

| | | | | | |
|---|---|---|---|---|---|
| 3,808,616 | A * | 5/1974 | White | A47C 1/146 | 5/419 |
| 4,631,765 | A * | 12/1986 | Casey | A47G 9/0207 | 5/420 |
| 4,662,851 | A * | 5/1987 | Foster | B63C 9/08 | 441/129 |
| 4,985,952 | A * | 1/1991 | Edelson | A47C 27/001 | 5/420 |
| 5,265,292 | A * | 11/1993 | Underell | A47C 1/146 | 5/420 |
| 5,437,569 | A * | 8/1995 | Ming | B63C 9/08 | 441/129 |
| 6,618,883 | B2 * | 9/2003 | Angland | A47C 17/04 | 5/417 |
| 6,711,766 | B2 * | 3/2004 | Monk | A47C 27/14 | 5/417 |

(Continued)

*Primary Examiner* — Lars A Olson

(74) *Attorney, Agent, or Firm* — Smith Tempel Blaha LLC; Matthew T. Hoots

(57) ABSTRACT

Exemplary embodiments of an improved water mat system comprise a plurality of polymeric, closed-cell foam panels, each of the plurality of panels taking any suitable shape and defining a top surface and a bottom surface. A plurality of hinge components are configured and placed to connect the plurality of panels and operable to transition the water mat system between a deployed state and a stored state. When the water mat system is in the deployed state the plurality of panels are positioned in an end-to-end arrangement such that the top surfaces of the panels collectively define a substantially common plane (i.e., the panels are laid out end-to-end). When the water mat system is in the stored state the top surface of a first one of the plurality of panels is juxtaposed to the bottom surface of a second one of the plurality of panels (i.e., the panels are stacked).

12 Claims, 6 Drawing Sheets

(56) References Cited

U.S. PATENT DOCUMENTS

| | | | | |
|---|---|---|---|---|
| 9,010,349 | B1 * | 4/2015 | Heacock | E04H 15/324 5/417 |
| 2013/0180046 | A1 * | 7/2013 | Davis, Jr. | A61G 7/1074 5/81.1 HS |
| 2016/0000231 | A1 * | 1/2016 | Auell | A47C 27/15 5/420 |

* cited by examiner

WATER MAT SYSTEM

BACKGROUND

The present invention relates to water mat solutions and, more particularly, to a novel water mat system configured for flotation on a large body of water to support one or more people.

Current water mats known in the art may be constructed from closed cell foam and take the form of a large mat. The water mats are configured to float on a large body of water such as a pool, or lake, or ocean in order to provide a floating surface desirable for play or lounging. Depending on the materials of construction and size dimensions, water mats known and used in the art may be operable to support anywhere from about 600 pounds to 1500 pounds of distributed weight without sinking.

In some applications, the larger the mat the more desirable the mat. Water mats known in the art, however, suffer from practical limitations to dimensional size ranges that are dictated by the need to "roll up" the mat when stored. Users of water mats known in the art have to roll the mats much like a bedroll or sleeping bag in order to store the mats on a dock, poolside or boat transom platform, as would be understood by one of ordinary skill in the art. Rolling water mats is a cumbersome process and makes storage of the water mats inconvenient. The requirement that water mats known in the art be stored in a rolled state also dictates that the relative thickness of the water mats cannot exceed about 1½ to 2 inches, as closed cell foam mats thicker than 2 inches resist rolling and/or dictate that the overall roll size exceeds a practical diameter. Moreover, the length and width of water mats known in the art are practically limited to no more than about six feet wide and 18 feet long (shorter dimensions for thicker mats), as exceeding such dimensions would dictate the need for a foam thickness too thin to support any significant amount of weight (due, again, to the requirement that the mat be stored in a rolled state).

Therefore, there is a need in the art for an improved water mat system. More specifically, there is a need in the art for a water mat system that leverages multiple panels of closed cell foam configured to be stored in a stacked state.

SUMMARY

Exemplary embodiments of an improved water mat system comprise a plurality of polymeric, closed-cell foam panels, each of the plurality of panels taking any suitable shape and defining a top surface and a bottom surface. A plurality of hinge components are configured and placed to connect the plurality of panels and operable to transition the water mat system between a deployed state and a stored state. When the water mat system is in the deployed state the plurality of panels are positioned in an end-to-end arrangement such that the top surfaces of the panels collectively define a substantially common plane. When the water mat system is in the stored state the top surface of a first one of the plurality of panels is juxtaposed to the bottom surface of a second one of the plurality of panels.

The plurality of polymeric, closed-cell foam panels may comprise multiple layers of foam, such as an XPE foam. The hinges, depending on embodiment, may take different forms such as, but not limited to, a pair of straps or multiple straps extending across a gap between adjacent panels, a single strap running longitudinally along a gap between adjacent panels, straps with eyelets and button arrangements, etc. The hinges, depending on embodiment, may be constructed from a thermoplastic or a rubber, although other water proof or water resistant materials are envisioned. Embodiments of a water mat system may also include a tether attached to at least one of the plurality of panels.

DETAILED DESCRIPTION

Figure 1:
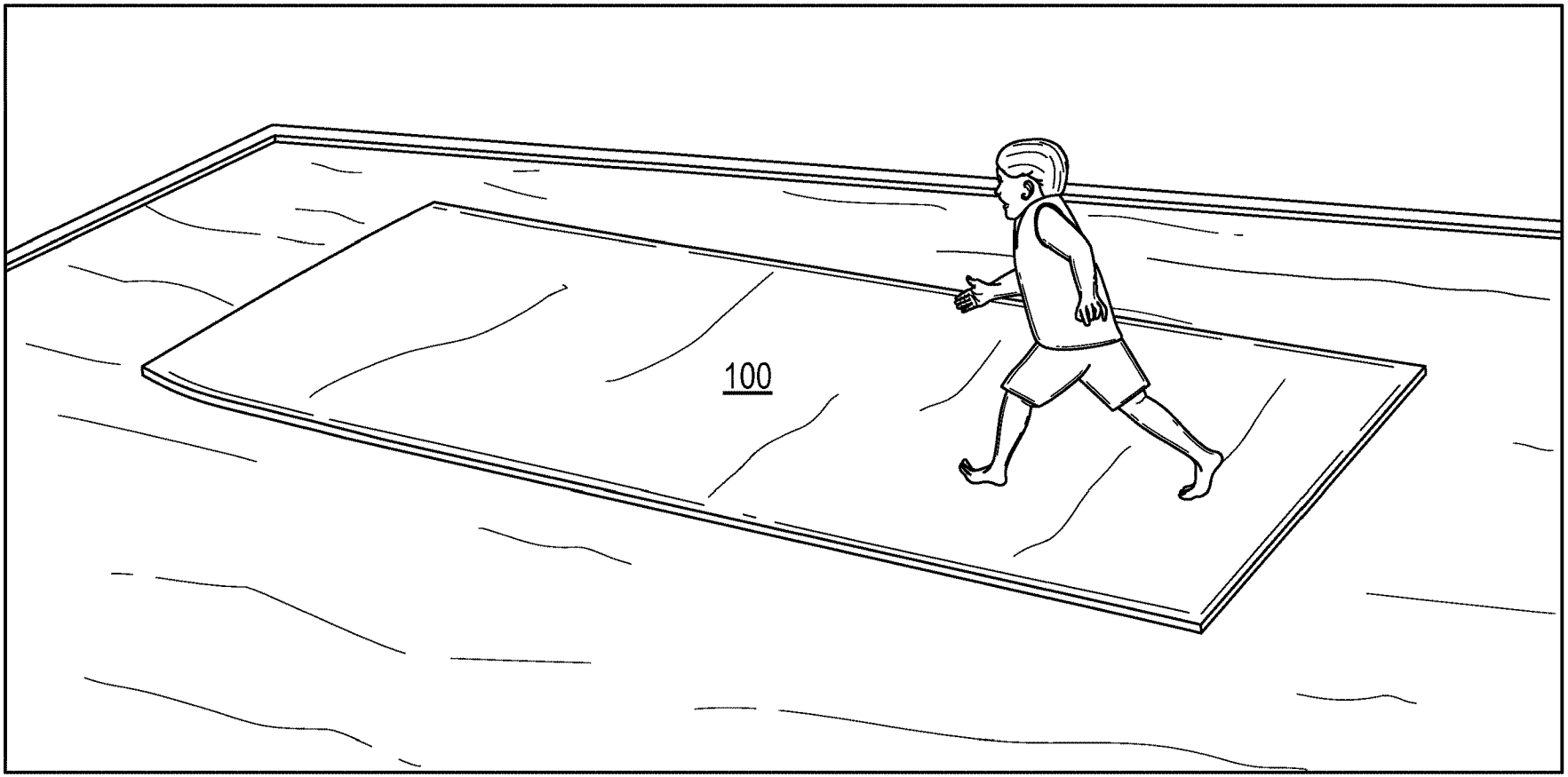
FIG. 1 (Prior Art)
FIG. 1 illustrates a typical water mat solution known in the art and constructed from a closed cell polymeric foam.

Various embodiments, aspects and features of the present invention encompass a water mat system that incorporates multiple closed cell foam panels in a serial connection. Unlike prior art solutions for a water mat, embodiments of the solution make be stored in a stacked state instead of a rolled state. Advantageously, because the multiple foam panels are hinged such that adjacently connected mats may be folded onto one another, embodiments of the solution are more easily transitioned between a stored state and an employed state than rolled solutions presently known in the art.

As will become more clear from the drawings and description that follows, embodiments of the solution may be comprised of any number of serially connected foam panels and, as such, embodiments of the solution are not limited in the number of panels that may be serially connected to form an improved water mat system. Therefore, even though the exemplary embodiments shown in the figures are illustrated with three serially connected foam panels, it will be understood that any number of serially connected panels may be used in a given embodiment without departing from the scope of the solution.

Additionally, embodiments of an improved water mat system according to the solution are generally directed toward water mat systems that leverage a closed cell foam or similar material, as opposed to serially connected inflatable panels or more complicated floating mat systems. That is, broadly speaking, the novel step embodied by the proposed solution envisions a structure that has serially connected, hinged panels of a closed cell foam that, advantageously, enable users to transition embodiments of the solution between stored and deployed states without rolling. Advantageously, and because the water mat system does not require rolling into a stored state, the panels comprised within an embodiment of a water mat system according to the solution may essentially take any shape, whether rectilinear or not (square, rectangular, round, oval, etc.), so long as the top and bottom presents a substantially flat surface. For this reason, even though the exemplary embodiments shown in the illustrations include rectangular panels, it will be understood that other shapes are envisioned without departing from the scope of the solution.

Materials of construction for embodiments of the solution may be selected according to knowledge and preferences held by those of ordinary skill in the art of floating water mats. It is envisioned that individual panels incorporated in an embodiment of the solution may be constructed from single or multiple layers of polymeric foam materials having similar or dissimilar densities and physical properties. Even so, it is envisioned that preferred embodiments of an improved water mat system according to the solution may comprise panels constructed from polyolefin or polyethylene foam such as, but not limited to, an XPE foam. As would be recognized by one of ordinary skill in the art, XPE is a chemically cross-linked polyethylene foam created from a low density polyethylene resin, cross-linking agent and foaming agent. XPE foam is resistant to water absorption, is chemically stable, difficult to decompose, odorless and flexible. Other foam types are envisioned as well and, as such, embodiments of the solution are not limited to construction from XPE foam.

When deployed, adjacent foam panels may be relatively tightly positioned relative to each other such that the multiple panels collectively form a single, large foam mat. Advantageously, when transitioning from a deployed state to a stored state, the hinges may be positioned and configured to allow a given panel to be folded over and onto an adjacent panel, thereby allowing a user to systematically stack the multiple panels that form the given embodiment of the improved water mat system. Because a user only has to manage one panel at a time when transitioning the system from a stored state to a deployed state, or vice versa, the process may be significantly less cumbersome than rolled single panel water mats known in the art.

Also, because embodiments of the solution leverage a series of connected panels, as opposed to one large panel like prior art solutions, panels in excess of two inches thick may be used in an improved water mat system (e.g. 2¼" to 3½"), thereby enabling relatively higher weight capacities than prior art solutions. Moreover, by leveraging a series of connected foam panels in lieu of one single panel such as that which is known in the prior art, embodiments of the solution may provide for relatively longer systems that exceed 20 feet in length when in a deployed state.

FIG. 1 illustrates a typical water mat solution known in the art and constructed from a closed-cell polymeric foam. As can be understood from the FIG. 1 illustration, a water mat known in the art (as well as embodiments of the present solution for an improved water mat system) is constructed from a buoyant foam capable of supporting the weight of multiple users. As would be understood by one of ordinary skill in the art, prior art water mats such as the one shown in a deployed state in the FIG. 1 illustration must be transitioned to a rolled state when not deployed.

Figure 2:
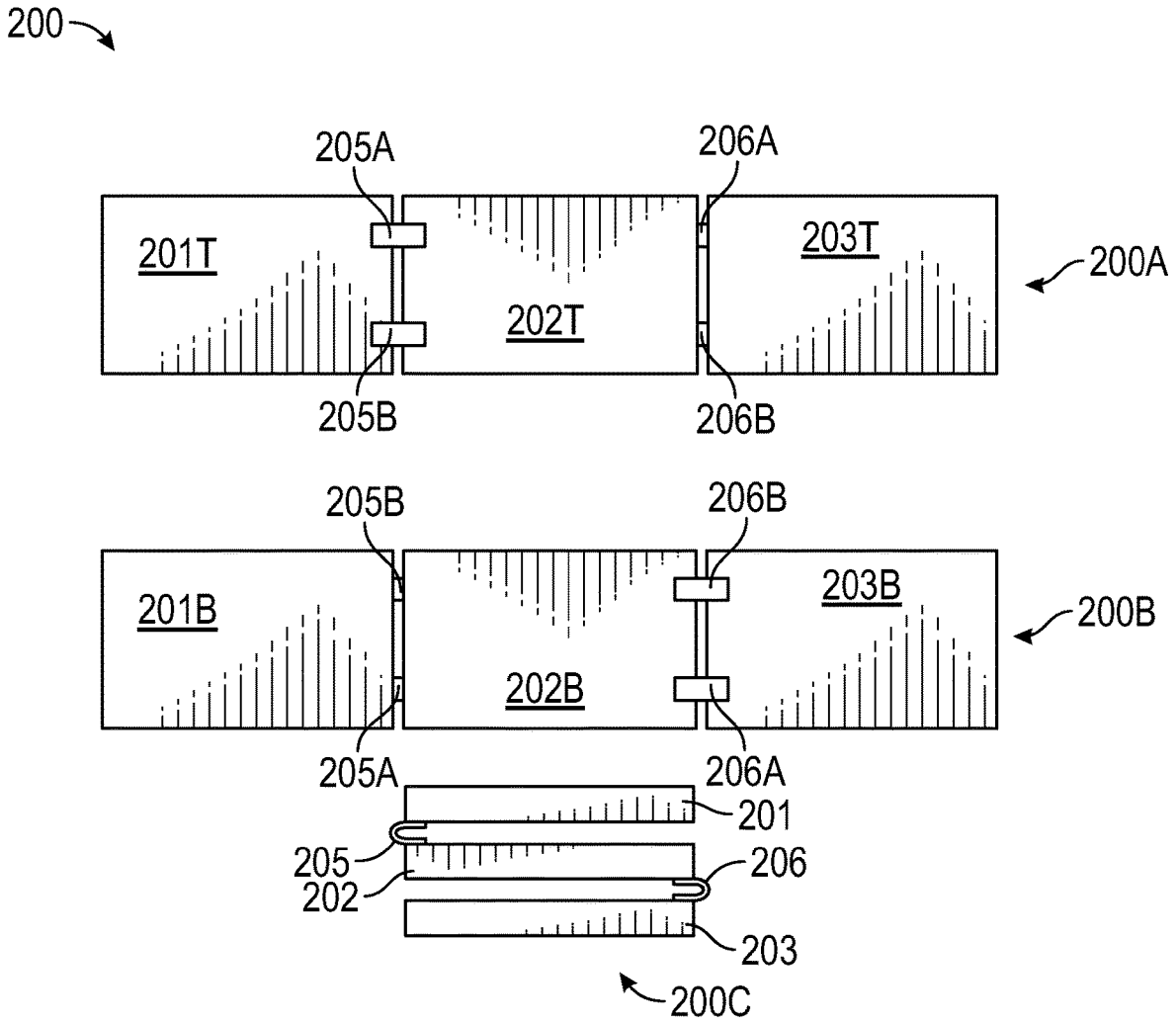
FIG. 2 illustrates an exemplary embodiment of an improved water mat system according to the solution having multiple closed cell foam panels serially connected via strapped hinge pairs.

FIG. 2 illustrates an exemplary embodiment of an improved water mat system 200 according to the solution, shown from a top view 200A of its deployed state, bottom view 200B of its deployed state, and side view 200C of its stored state. As can be understood from the FIG. 2 illustration, the exemplary embodiment 200 comprises multiple closed-cell foam panels 201, 202, 203 serially connected via strapped hinge pairs 205, 206. One or more of the panels 201, 202, 203 may include a tether (not shown in the illustration) for attaching the water mat system to another object such as, for example, a boat or dock, as would be understood by one of ordinary skill in the art. Notably, and as aforementioned, it is envisioned that embodiments of the solution may comprise any number of serially connected panels and, as such, the depiction of only three panels 201, 202, 203 in the illustration is not meant to suggest that the scope of the solution is limited to embodiments having exactly three panels. That is, embodiments of the solution may have two panels, three panels, or more than three panels.

Each panel 201, 202, 203 may be constructed from closed cell foam, as described above. Depending on the embodiment, the top side of a panel 201T, 202T, 203T may be constructed from a closed cell foam that is different in formulation, or at least different in color, from the material used for the bottom side of the same panel 201B, 202B, 203B. Moreover, a given panel 201, 202, 203 may be constructed from multiple layers of closed cell foam or other buoyant material.

As can be seen in the illustration, each of the panels 201, 202, 203 is mechanically connected to its adjacent panel(s) via a pair of strap-type hinges 205, 206. Panel 201 is connected to panel 202 via hinge pair 205. Similarly, panel 203 is connected to the opposite end of panel 202 via hinge pair 206. Notably, although the exemplary embodiment depicts hinge components 205, 206 as pairs 205A, 205B and 206A, 206B, it is envisioned that other embodiments may leverage more than two strap hinges to connect adjacent panels. For instance, it is envisioned that alternative embodiments may leverage a plurality of relatively smaller straps to connect adjacent panels.

The strap hinges 205, 206 may be constructed from any suitable material that is flexible and water resistant such as, but not limited to, a woven thermoplastic (e.g., nylon), a silicon rubber, etc. In this way, the panels 201, 202, 203 may be folded out relative one to the other such that the water mat system 200 takes a deployed state when the strap hinges 205, 206 are extended such as shown in 200A, 200B. When in a deployed state, planes defined by 201T, 202T and 203T may share a substantially common plane. The strap hinges 205, 206 may be mechanically anchored to the panels 201, 202, 203 via glue, thermomelting, stitching, or any other means suitable for the application.

Conversely, and advantageously, the water mat system 200 may be converted to a stored state 200C by folding adjacent panels onto each other such that the panels 201, 202, 203 are stacked. Referring to illustration 200C, the water mat system 200 is in a stored state when 201T is juxtaposed to 202T and 203B is juxtaposed to 202B. In order for panel 201 to be positionally transitioned such that 201T is juxtaposed in a parallel plane to 202T, strap hinges 205 may be bent or folded, as illustrated in 200C. Similarly, in order for panel 203 to be positionally transitioned such that 203B is juxtaposed to 202B, strap hinges 206 may be bent or folded, as illustrated in 200C.

Figure 3:
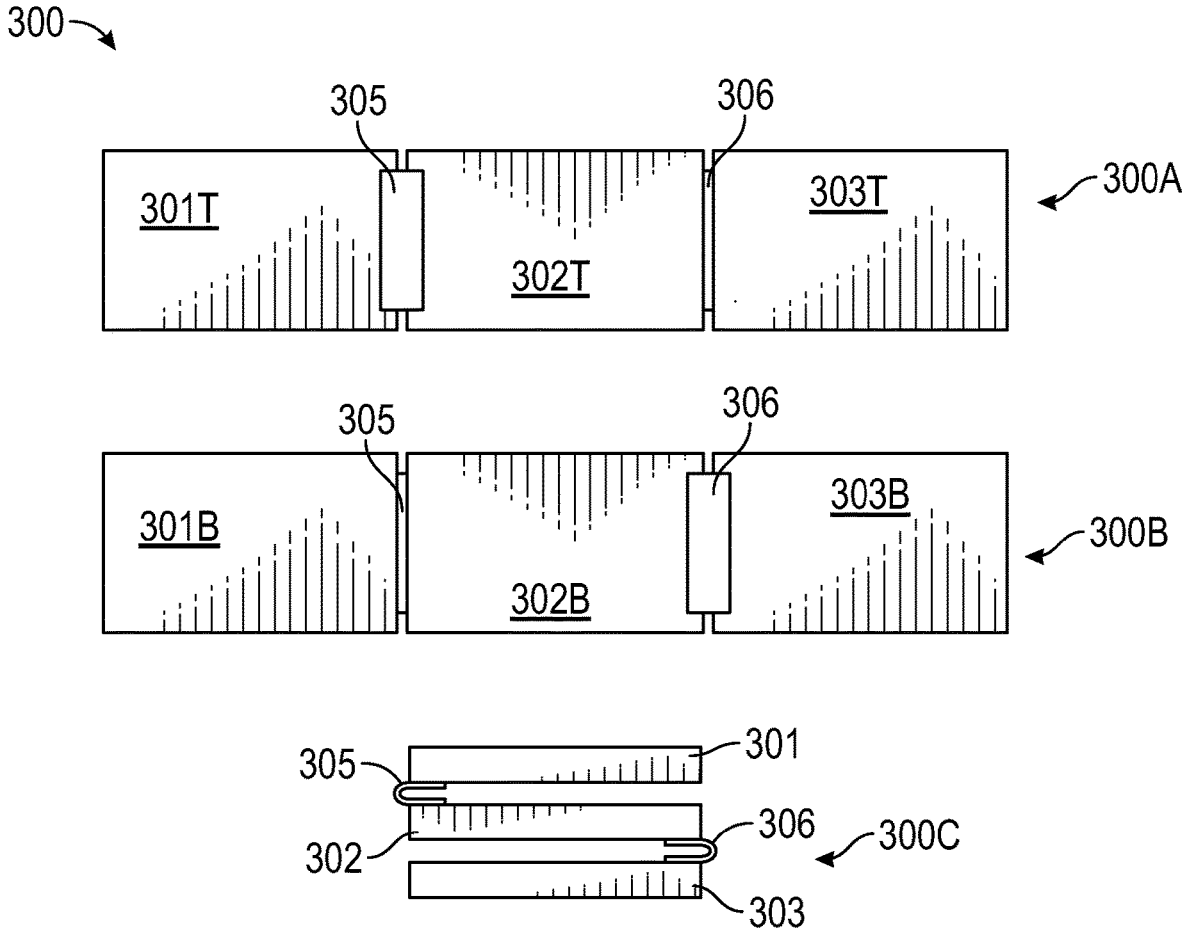
FIG. 3 illustrates an exemplary embodiment of an improved water mat system according to the solution having multiple closed cell foam panels serially connected via single strapped hinges.

FIG. 3 illustrates an exemplary embodiment of an improved water mat system 300 according to the solution, shown from a top view 300A of its deployed state, bottom view 300B of its deployed state, and side view 300C of its stored state. As can be understood from the FIG. 3 illustration, the exemplary embodiment 300 comprises multiple closed cell foam panels 301, 302, 303 serially connected via single strapped hinges 305, 306. Notably, and as aforementioned, it is envisioned that embodiments of the solution may comprise any number of serially connected panels and, as such, the depiction of only three panels 301, 302, 303 in the illustration is not meant to suggest that the scope of the solution is limited to embodiments having exactly three panels. That is, embodiments of the solution may have two panels, three panels, or more than three panels.

Each panel 301, 302, 303 may be constructed from closed cell foam, as described above. Depending on the embodiment, the top side of a panel 301T, 302T, 303T may be constructed from a closed cell foam that is different in formulation, or at least different in color, from the material used for the bottom side of the same panel 301B, 302B, 303B. Moreover, a given panel 301, 302, 303 may be constructed from multiple layers of closed cell foam or other buoyant material.

As can be seen in the illustration, each of the panels 301, 302, 303 is mechanically connected to its adjacent panel(s) via a single strap-type hinge 305, 306. Panel 301 is connected to panel 302 via hinge 305. Similarly, panel 303 is connected to the opposite end of panel 302 via hinge 306.

The strap hinges 305, 306 may be constructed from any suitable material that is flexible and water resistant such as, but not limited to, a woven nylon, a silicon rubber, etc. In this way, the panels 301, 302, 303 may be folded out relative one to the other such that the water mat system 300 takes a deployed state when the strap hinges 305, 306 are extended such as shown in 300A, 300B. When in a deployed state, planes defined by 301T, 302T and 303T may share a substantially common plane.

Conversely, and advantageously, the water mat system 300 may be converted to a stored state 300C by folding adjacent panels onto each other such that the panels 301, 302, 303 are stacked. Referring to illustration 300C, the water mat system 300 is in a stored state when 301T is juxtaposed to 302T and 203B is juxtaposed to 302B. In order for panel 301 to be positionally transitioned such that 301T is juxtaposed in a parallel plane to 302T, strap hinges 305 may be bent or folded, as illustrated in 300C. Similarly, in order for panel 303 to be positionally transitioned such that 303B is juxtaposed to 302B, strap hinges 306 may be bent or folded, as illustrated in 300C.

Figure 4:
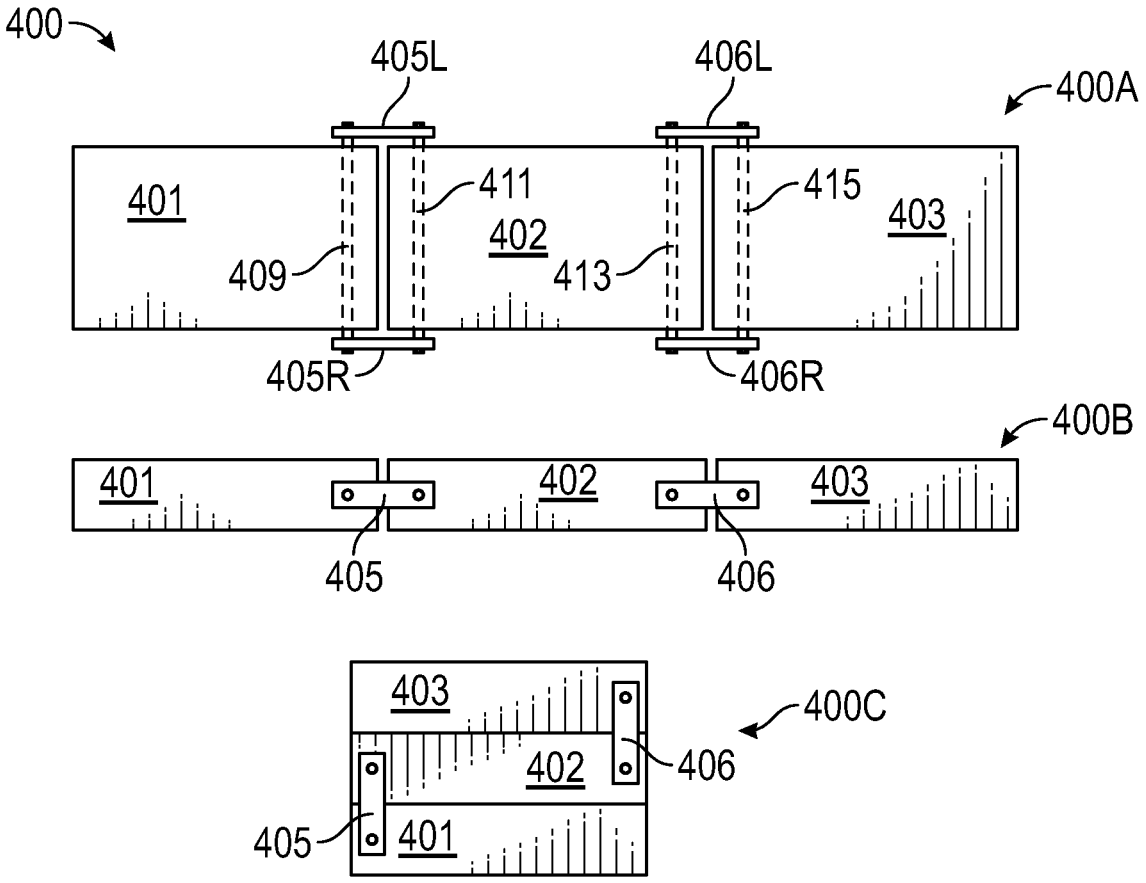
FIG. 4 illustrates an exemplary embodiment of an improved water mat system according to the solution having multiple closed cell foam panels serially connected via side-mounted hinges coupling cross-bars through adjacent panels.

FIG. 4 illustrates an exemplary embodiment of an improved water mat system 400 according to the solution having multiple closed cell foam panels 401, 402, 403 serially connected via side-mounted hinges 405, 406 coupling cross-bars 409, 411, 413, 415 through adjacent panels. The FIG. 4 illustration of water mat system embodiment 400 includes a top or bottom view 400 of its deployed state, side view 400B of its deployed state, and side view 400C of its stored state. As can be understood from the FIG. 4 illustration, the exemplary embodiment 400 comprises multiple closed cell foam panels 401, 402, 403 serially connected via hinge and cross bar arrangements (described in more detail below). Notably, and as aforementioned, it is envisioned that embodiments of the solution may comprise any number of serially connected panels and, as such, the depiction of only three panels 401, 402, 403 in the illustration is not meant to suggest that the scope of the solution is limited to embodiments having exactly three panels. That is, embodiments of the solution may have two panels, three panels, or more than three panels.

Each panel 401, 402, 403 may be constructed from closed cell foam, as described above. Depending on the embodiment, the top side of a panel 401, 402, 403 may be constructed from a closed cell foam that is different in formulation, or at least different in color, from the material used for the bottom side of the same panel 401, 402, 403. Moreover, a given panel 401, 402, 403 may be constructed from multiple layers of closed cell foam or other buoyant material.

As can be seen in the illustration, each of the panels 401, 402, 403 is mechanically connected to its adjacent panel(s) via hinge and cross bar arrangements. Panel 401 is connected to panel 402 via hinges 405L and 405R which are rotationally connected to the ends of crossbars 409 and 411. As can be understood from the FIG. 4 illustration, crossbar 409 runs through the body of panel 401 at or near a first end of panel 401. Similarly, crossbar 411 runs through the body of panel 402 at or near a first end of panel 402. The first end of panel 401 is juxtaposed to the first end of panel 402 such that hinges 405L and 405R may be leveraged to mechanically connect the respective ends of crossbars 409 and 411. Similarly, a crossbar 413 runs through a second end of panel 402 and a crossbar 403 runs through a first end of panel 403. Hinges 406L and 406R connect the respective ends of crossbars 413 and 415. It is envisioned that the crossbars 409, 411, 413, 415 may be constructed from a somewhat flexible material such as, but not limited to, a silicon rubber such that when in a deployed state a user may apply weight to the water mat system 400 and cause the crossbar(s) to flex or bend with the panel foam.

The hinges 405, 406 may also be constructed from a relatively flexible material in some embodiments, such as but not limited to silicon rubber, but may in other embodiments be constructed from a relatively high durometer material such as a plastic polymer. Because the crossbars 409, 411, 413, 415 are rotationally mounted to hinges 405, 406, the panels 401, 402, 403 may be folded out relative one to the other such that the water mat system 400 takes a deployed state as shown in 400A, 400B. When in a deployed state, planes defined by 401, 402 and 403 may share a substantially common plane.

Conversely, and advantageously, the water mat system 400 may be converted to a stored state 400C by folding adjacent panels onto each other such that the panels 401, 402, 403 are stacked. Referring to illustration 400C, the water mat system 400 is in a stored state when 401 is juxtaposed parallel to and beneath 402 which, in turn, is juxtaposed parallel to and beneath 403. In order for panel 401 to be positionally transitioned such that it is juxtaposed parallel to and beneath 402, hinge 405 may be caused to run vertically from 401 to 402 (hinge 405 may be caused to run horizontally from 401 to 402 when the mat system 400 is in a deployed state), as illustrated in 400C. Similarly, in order for panel 403 to be positionally transitioned such that it is juxtaposed parallel to and above 402, hinge 406 may be caused to run vertically from 402 to 403 (hinge 406 may be caused to run horizontally from 402 to 403 when the mat system 400 is in a deployed state), as illustrated in 400C.

Figure 5:
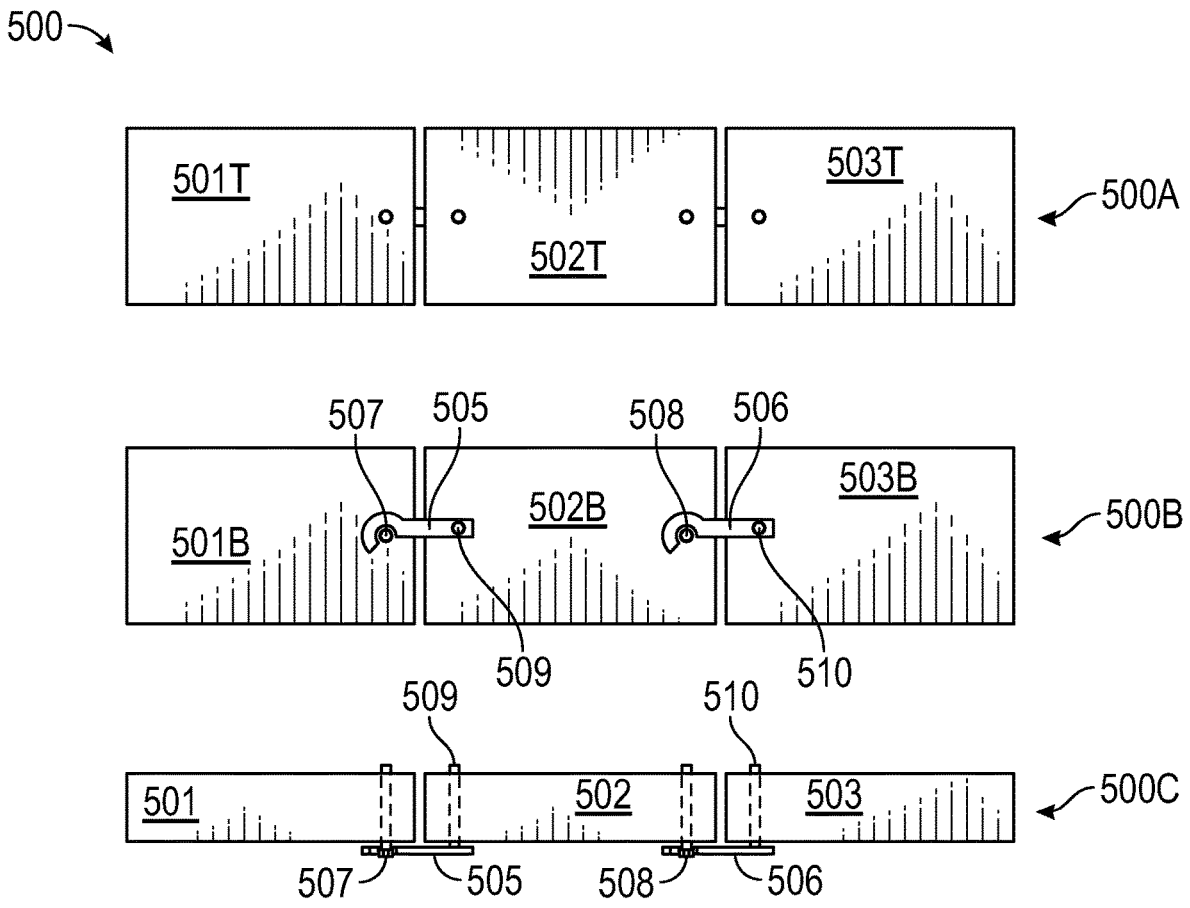
FIG. 5 illustrates an exemplary embodiment of an improved water mat system according to the solution having multiple closed cell foam panels serially connected via hook and post fasteners.

FIG. 5 illustrates an exemplary embodiment of an improved water mat system 500 according to the solution having multiple closed cell foam panels 501, 502, 503 serially connected via hook and post fasteners. The FIG. 5 illustration of water mat system embodiment 500 includes a top view 500A of its deployed state, a bottom view 500B of its deployed state, and side view 500C of its deployed state. In a stored state, the water mat system 500 may simply take the form of separated and stacked panels. That is, unlike the previous embodiments shown and described, the embodiment 500 does not include hinges and, as such, the panels may be separated one from the other and stored individually.

As can be understood from the FIG. 5 illustration, the exemplary embodiment 500 comprises multiple closed cell foam panels 501, 502, 503 serially connected via hook and post fasteners. Notably, and as aforementioned, it is envisioned that embodiments of the solution may comprise any number of serially connected panels and, as such, the depiction of only three panels 501, 502, 503 in the illustration is not meant to suggest that the scope of the solution is limited to embodiments having exactly three panels. That is, embodiments of the solution may have two panels, three panels, or more than three panels.

Each panel 501, 502, 303 may be constructed from closed cell foam, as described above. Depending on the embodiment, the top side of a panel 501T, 502T, 503T may be constructed from a closed cell foam that is different in formulation, or at least different in color, from the material used for the bottom side of the same panel 501B, 502B, 503B. Moreover, a given panel 501, 502, 503 may be constructed from multiple layers of closed cell foam or other buoyant material.

As can be seen in the illustration, each of the panels 501, 502, 503 is mechanically connected to its adjacent panel(s) via a hook and post arrangement. Panel 501 is connected to panel 502 via hook 505 that is rotationally anchored to a first end of panel 502 at post 509 and is operable to engage post 507 in panel 501. Similarly, panel 503 is connected to the opposite end of panel 502 via hook 506 that is rotationally anchored to a first end of panel 503 at post 510 and is operable to engage post 508 in panel 502. The hooks and posts may be constructed from a relatively flexible material in some embodiments, such as but not limited to silicon rubber, but may in other embodiments be constructed from a relatively high durometer material such as a plastic polymer.

Figure 6:
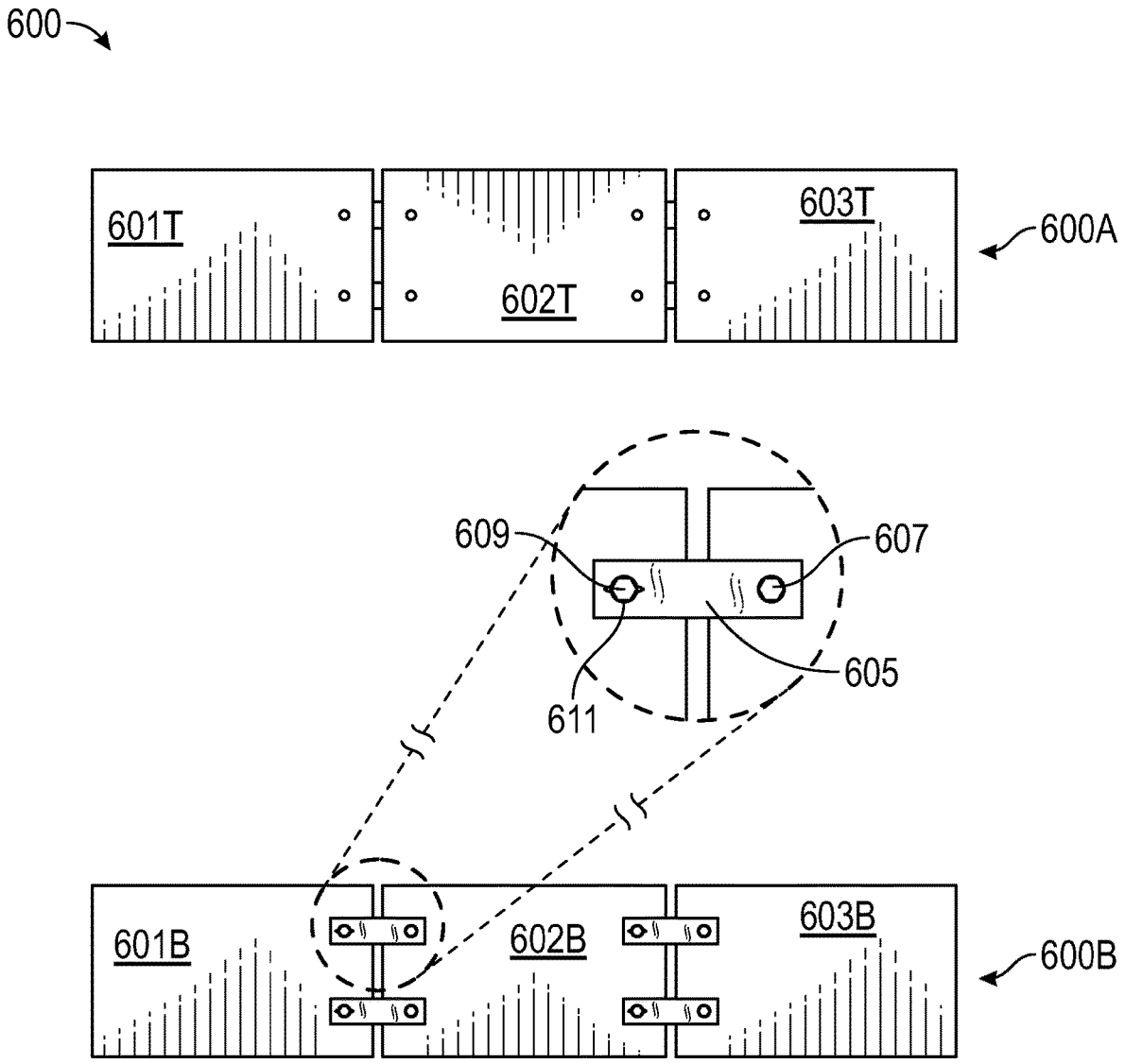
FIG. 6 illustrates an exemplary embodiment of an improved water mat system according to the solution having multiple closed cell foam panels serially connected via button and eyelets.

FIG. 6 illustrates an exemplary embodiment of an improved water mat system 600 according to the solution having multiple closed cell foam panels serially connected via button and eyelets. The FIG. 6 illustration of water mat system embodiment 600 includes a top view 600A of its deployed state and bottom view 600B of its deployed state. In a stored state, the water mat system 600 may simply take the form of separated and stacked panels or, optionally, may be folded into a stored state in much the same way as previously shown and described relative to the exemplary embodiment 200 of FIG. 2.

As can be understood from the FIG. 6 illustration, the exemplary embodiment 600 comprises multiple closed cell foam panels 601, 202, 603 serially connected via strapped button and eyelet hinge pairs (exemplary button and eyelet strap hinge shown in the close-up view in the FIG. 6 illustration and described in more detail below). Notably, and as aforementioned, it is envisioned that embodiments of the solution may comprise any number of serially connected panels and, as such, the depiction of only three panels 601, 602, 603 in the illustration is not meant to suggest that the scope of the solution is limited to embodiments having exactly three panels. That is, embodiments of the solution may have two panels, three panels, or more than three panels.

Each panel 601, 602, 603 may be constructed from closed cell foam, as described above. Depending on the embodiment, the top side of a panel 601T, 602T, 603T may be constructed from a closed cell foam that is different in formulation, or at least different in color, from the material used for the bottom side of the same panel 601B, 602B, 603B. Moreover, a given panel 601, 602, 603 may be constructed from multiple layers of closed cell foam or other buoyant material.

As can be seen in the illustration, each of the panels 601, 602, 203 is mechanically connected to its adjacent panel(s) via a pair of strap-type hinges that include button and eyelet aspects. The strap hinges may be constructed from any suitable material that is flexible and water resistant such as, but not limited to, a woven nylon, a silicon rubber, etc. In this way, the panels 601, 602, 603 may be folded out relative one to the other such that the water mat system 600 takes a deployed state when the strap hinges are engaged and extended such as shown in 600A, 600B. When in a deployed state, planes defined by 601T, 602T and 603T may share a substantially common plane.

Conversely, and advantageously, the water mat system 600 may be converted to a stored state (not shown) by folding adjacent panels onto each other such that the panels 601, 602, 603 are stacked, similar to that which has been shown and described relative to the embodiment of FIG. 2. Referring to the close-up view in the FIG. 6 illustration, the button and eyelet arrangement of the hinges of the embodiment 600 can be better understood. A strap hinge 600 is anchored by a post 607 to an end of a panel. At the end of the strap that is opposite the post 600, an eyelet or slit 611 is configured and operable to mechanically engage a post 609 that functions much like a button and is anchored in an adjacent panel. In this way, the various panels may be releasably connected, one to the other. Once connected, the water mat system embodiment 600 may be transitioned between stored and deployed states, as would be understood from review of the above descriptions. Alternatively, the panels may be disengaged into separate and individual panels via disengagement of the button and eyelet arrangements of the hinges.

An improved water mat system according to the solution has been described using detailed descriptions of embodiments thereof that are provided by way of example and are not intended to limit the scope of the disclosure. The described embodiments comprise different features, not all of which are required in all embodiments of an improved water mat system according to the solution. Some embodiments of the solution utilize only some of the features or possible combinations of the features. Variations of embodiments of the solution that are described and embodiments of the solution comprising different combinations of features noted in the described embodiments will occur to persons of the art.

It will be appreciated by persons skilled in the art that an improved water mat system according to the solution is not limited by what has been particularly shown and described herein above. Rather, the scope of an improved water mat system according to the solution is defined by the claims that follow.

What is claimed is:

1. An improved water mat system, the water mat system comprising:

a plurality of polymeric, closed-cell foam panels, wherein each of the plurality of panels defines a top surface and a bottom surface; and a plurality of hinge components configured to connect the plurality of panels and operable to transition the water mat system between a deployed state and a stored state;

wherein when the water mat system is in the deployed state all of the plurality of panels are positioned in an end-to-end arrangement such that the top surfaces of the panels collectively define a substantially common plane; and wherein when the water mat system is in the stored state the top surface of a first one of the plurality of panels is juxtaposed to the top surface of a second one of the plurality of panels.

2. The improved water mat system of claim 1, wherein at least one of the plurality of polymeric, closed-cell foam panels comprises multiple layers of foam.

3. The improved water mat system of claim 1, wherein at least one of the plurality of polymeric, closed-cell foam panels comprises an XPE foam.

4. The improved water mat system of claim 1, wherein the plurality of hinge components comprises a pair of straps between two of the plurality of panels.

5. The improved water mat system of claim 4, wherein the pair of straps is constructed from one of a thermoplastic and a rubber.

6. The improved water mat system of claim 1, wherein the plurality of hinge components comprises a single strap between two of the plurality of panels.

7. The improved water mat system of claim 6, wherein the single strap is constructed from one of a thermoplastic and a rubber.

8. The improved water mat system of claim 1 further comprising a tether.

9. The improved water mat system of claim 1, wherein each of the plurality of panels has a dimensional thickness within a range of 2¼ inches to 3½ inches.

10. The improved water mat system of claim 1, wherein the plurality of panels comprises three or more panels.

11. The improved water mat system of claim 1, wherein the plurality of panels are separably connected via the plurality of hinge components.

12. The improved water mat system of claim 11, wherein the plurality of hinge components comprise a button and eyelet configuration.

* * * * *